US008175280B2

(12) United States Patent
Villemoes et al.

(10) Patent No.: US 8,175,280 B2
(45) Date of Patent: May 8, 2012

(54) GENERATION OF SPATIAL DOWNMIXES FROM PARAMETRIC REPRESENTATIONS OF MULTI CHANNEL SIGNALS

(75) Inventors: Lars Villemoes, Jaerfaella (SE); Kristofer Kjoerling, Solna (SE); Jeroen Breebaart, Eindhoven (NL)

(73) Assignee: Dolby International AB, Amsterdam Zuid-Oost (NL)

( * ) Notice: Subject to any disclaimer, the term of this patent is extended or adjusted under 35 U.S.C. 154(b) by 1408 days.

(21) Appl. No.: 11/469,799

(22) Filed: Sep. 1, 2006

(65) Prior Publication Data

US 2007/0223708 A1 Sep. 27, 2007

Related U.S. Application Data

(60) Provisional application No. 60/744,555, filed on Apr. 10, 2006.

(51) Int. Cl.
*H04R 5/00* (2006.01)

(52) U.S. Cl. ..... 381/17; 381/1; 381/18; 381/22; 381/23; 381/307; 381/309; 381/310; 455/205

(58) Field of Classification Search ..... 381/17, 381/309, 1, 18, 22, 23, 307, 310; 455/205
See application file for complete search history.

(56) References Cited

U.S. PATENT DOCUMENTS

| | | | | |
|---|---|---|---|---|
| 5,657,350 | A | 8/1997 | Hofmann | |
| 5,771,295 | A | 6/1998 | Waller, Jr. | |
| 6,198,827 | B1 | 3/2001 | Waller, Jr. | |
| 6,314,391 | B1 | 11/2001 | Tsutsui et al. | |
| 6,725,372 | B1 | 4/2004 | Lewis et al. | 713/176 |
| 2002/0006203 | A1 | 1/2002 | Tachibana et al. | 380/269 |
| 2002/0176353 | A1 | 11/2002 | Atlas et al. | 370/203 |
| 2003/0035553 | A1 | 2/2003 | Baumgarte | |

(Continued)

FOREIGN PATENT DOCUMENTS

| | | |
|---|---|---|
| CN | 1685763 | 10/2005 |

(Continued)

OTHER PUBLICATIONS

Faller, C. et al, "Binaural Cue Coding—Part II: Schemes and Applications," IEEE Transactions on Speech and Audio Processing, IEEE Service Center, New York, NY, vol. 11, No. 6, Nov. 2003, pp. 520-531.

(Continued)

*Primary Examiner* — Xu Mei
*Assistant Examiner* — Paul Kim
(74) *Attorney, Agent, or Firm* — Glen Patent Group; Michael A. Glenn

(57) ABSTRACT

A headphone down mix signal can be efficiently derived from a parametric down mix of a multi-channel signal, when modified HRTFs (head related transfer functions) are derived from HRTFs of a multi-channel signal using a level parameter having information on a level relation between two channels of the multi-channel signals such that a modified HRTF is stronger influenced by the HRTF of a channel having a higher level than by the HRTF of a channel having a lower level. Modified HRTFs are derived within the decoding process taking into account the relative strength of the channels associated to the HRTFs. The HRTFs are thus modified such that a down mix signal of a parametric representation of a multi-channel signal can directly be used to synthesize the headphone down mix signal without the need of an intermediate full parametric multi-channel reconstruction of the parametric down mix.

27 Claims, 5 Drawing Sheets

U.S. PATENT DOCUMENTS

| | | | | |
|---|---|---|---|---|
| 2003/0185411 | A1 | 10/2003 | Atlas et al. | 381/98 |
| 2006/0045274 | A1 * | 3/2006 | Aarts et al. | 381/17 |

FOREIGN PATENT DOCUMENTS

| | | | |
|---|---|---|---|
| DE | 19640814 | A1 | 10/1996 |
| DE | 19947877 | A1 | 10/1999 |
| DE | 10129239 | C1 | 6/2001 |
| EP | 0858243 | A2 | 8/1998 |
| RU | 2123728 | C1 | 12/1998 |
| RU | 2221329 | C2 | 1/2004 |
| WO | 97/33391 | | 9/1997 |
| WO | 03/096337 | A2 | 11/2003 |
| WO | WO2006/008683 | | 1/2006 |

OTHER PUBLICATIONS

Atlas, Les et al., "Joint Acoustic and Modulation Frequency", *EURASIP Journal on Applied Signal Processing* (2003), vol. 7, pp. 668-675.

Celik, Mehmet et al., "Collusion-Resilient Fingerprinting Using Random Pre-Warping", *Electrical and Computer Engineering Dept., University of Rochester*, Rochester, NY, 0-7803-7750-8/03, pp. I-509-I-512 (2003).

Dittman, Jana "Combining Digital Watermarks and Collusion Secure Fingerprints for Customer Copy Monitoring", *The Institution of Electrical Engineers*, IEE, Savoy Place, Lundon, UK, XP-001151849, Oct. 4, 2000, pp. 1-6.

Haitsma, Jaap et al., "Audio Watermarking for Monitoring and Copy Protection", *Philips Research Laboratories*, Endhoven, The Netherlands, Aug. 4, 2004, pp. 1-5.

Houtgast, T., "Frequency Selectivity in Amplitude-Modulation Detection", *J. Acoust. Soc. Am.*, vol. 85(4), Apr. 1989, pp. 1676-1680.

Neubauer, C. et al., "A Compatible Family of Bitstream Watermarking Schemes for MPEG-Audio", *AES Convention Paper 5346*, Presented at the 110$^{th}$ Convention May 12-15, 2001, Amsterdam, The Netherlands, pp. 1-12.

Neubauer, C. et al., "Advanced Watermarking and its Applications", *Fraunhofer Institute for Integrated Circuits IIS*, Erlangen, Germany, pp. 1-19.

Neubauer, C. et al., "Audio Watermarking of MPEG-2 AAC Bit Streams", *Presented at The AESs 108$^{th}$ Convention*, Paris, France, Feb. 19-22, 2000, Coversheet and pp. 1-19.

Neubauer, C., "Digital Watermarking and its Influence on Audio Quality", *Fraunhofer Institute for Integrated Circuits IIS*, Erlangen, Germany, pp. 1-16.

Siebenhaar, F., et al. "Combined Compression/Watermarking for Audio Signals", *AES Presented at the 110$^{th}$ Convention*, Amsterdam, The Netherlands, May 12-15, 2001, pp. 1-10.

Thompson, Jeffrey K., et al., "A Non-Uniform Modulation Transform for Audio Coding With Increased Time Resolution", *IEEE ICASSP*, (2003), pp. V-397-V-400.

Van der Veen, Michiel et al., "Robust, Multi-Functional and High-Quality Audio Watermarking Technology", *AES 110$^{th}$ Convention Paper 5345*, Amsterdam, The Netherlands, May 12-15, 2001, pp. 2-9.

Vinton, Mark S., et al., "A Scalable and Progressive Audio Codec", *Appeared in IEEE ICASSP* (2001), May 7-11, 2001, Salt Lake City, UT, 3 pages.

English Translation of Russian Decision to Grant in related Russian application No. 2008142141/09(054713), decision mailed on Jun. 15, 2010, 6 pages.

* cited by examiner

400

GENERATION OF SPATIAL DOWNMIXES FROM PARAMETRIC REPRESENTATIONS OF MULTI CHANNEL SIGNALS

CROSS-REFERENCE TO RELATED APPLICATIONS

This application claims priority to U.S. patent application Ser. No. 60/744,555 filed Apr. 10, 2006, and Swedish patent application 0600674-6, filed Mar. 24, 2006, which is incorporated herein in its entirety by this reference made thereto.

FIELD OF THE INVENTION

The present invention relates to decoding of encoded multi-channel audio signals based on a parametric multi-channel representation and in particular to the generation of 2-channel downmixes providing a spatial listening experience as for example a headphone compatible down mix or a spatial downmix for 2 speaker setups.

BACKGROUND OF THE INVENTION IN PRIOR ART

Recent development in audio coding has made available the ability to recreate a multi-channel representation of an audio signal based on a stereo (or mono) signal and corresponding control data. These methods differ substantially from older matrix based solutions such as Dolby Prologic, since additional control data is transmitted to control the re-creation, also referred to as up-mix, of the surround channels based on the transmitted mono or stereo channels.

Hence, such a parametric multi-channel audio decoder, e.g. MPEG Surround, reconstructs N channels based on M transmitted channels, where N>M, and the additional control data. The additional control data represents a significant lower data rate than transmitting the all N channels, making the coding very efficient while at the same time ensuring compatibility with both M channel devices and N channel devices.

These parametric surround coding methods usually comprise a parameterization of the surround signal based on IID (Inter channel Intensity Difference) or CLD (Channel Level Difference) and ICC (Inter Channel Coherence). These parameters describe power ratios and correlations, between channel pairs in the up-mix process. Further parameters also used in prior art comprise prediction parameters used to predict intermediate or output channels during the up-mix procedure.

Other developments in reproduction of multi-channel audio content have provided means to obtain a spatial listening impression using stereo headphones. To achieve a spatial listening experience using only the two speakers of the headphones, multi-channel signals are down mixed to stereo signals using HRTF (head related transfer functions), intended to take into account the extremely complex transmission characteristics of a human head for providing the spatial listening experience.

Another related approach is to use a conventional 2-channel playback environment and to filter the channels of a multi-channel audio signal with appropriate filters to achieve a listening experience close to that of the playback with the original number of speakers. The processing of the signals is similar as in the case of headphone playback to create an appropriate "spatial stereo down mix" having the desired properties. Contrary to the headphone case, the signal of both speakers directly reaches both ears of a listener, causing undesired "crosstalk effects". As this has to be taken into account for optimal reproduction quality, the filters used for signal processing are commonly called crosstalk-cancellation filters. Generally, the aim of this technique is to extend the possible range of sound sources outside the stereo speaker base by cancellation of inherent crosstalk using complex crosstalk-cancellation filters.

Because of the complex filtering, HRTF filters are very long, i.e. they may comprise several hundreds of filter taps each. For the same reason, it is hardly possible to find a parameterization of the filters that works well enough not to degrade the perceptual quality when used instead of the actual filter.

Thus, on the one hand, bit saving parametric representations of multi-channel signals do exist that allow for an efficient transport of an encoded multi-channel signal. On the other hand, elegant ways to create a spatial listening experience for a multi-channel signal when using stereo headphones or stereo speakers only are known. However, these require the full number of channels of the multi-channel signal as input for the application of the head related transfer functions that create the headphone down mix signal. Thus, either the full set of multi-channels signals has to be transmitted or a parametric representation has to be fully reconstructed before applying the head related transfer functions or the crosstalk-cancellation filters and thus either the transmission bandwidth or the computational complexity is unacceptably high.

SUMMARY OF THE INVENTION

It is the object of the present invention to provide a concept allowing for a more efficient reconstruction of a 2-channel signal providing a spatial listening experience using parametric representations of multi-channel signals.

In accordance with a first aspect of the present invention, this object is achieved by a decoder for deriving a headphone down mix signal using a representation of a down mix of a multi-channel signal and using a level parameter having information on a level relation between two channels of the multi-channel signal and using head-related transfer functions related to the two channels of the multi-channel signal, comprising: a filter calculator for deriving modified head-related transfer functions by weighting the head-related transfer functions of the two channels using the level parameter such that a modified head-related transfer function is stronger influenced by the head-related transfer function of a channel having a higher level than by the head-related transfer function of a channel having a lower level; and a synthesizer for deriving the headphone down mix signal using the modified head-related transfer functions and the representation of the down mix signal.

In accordance with a second aspect of the present invention, this object is achieved by a binaural decoder, comprising: a decoder for deriving a headphone down mix signal using a representation of a down mix of a multi-channel signal and using a level parameter having information on a level relation between two channels of the multi-channel signal and using head-related transfer functions related to the two channels of the multi-channel signal, comprising: a filter calculator for deriving modified head-related transfer functions by weighting the head-related transfer functions of the two channels using the level parameter such that a modified head-related transfer function is stronger influenced by the head-related transfer function of a channel having a higher level than by the head-related transfer function of a channel having a lower level; and a synthesizer for deriving the headphone down mix signal using the modified head-related transfer functions and the representation of the down mix signal; an analysis filterbank for deriving the representation of the down mix of the multi-channel signal by subband filtering the downmix of the multi-channel signal; and a synthesis filterbank for deriving a time-domain headphone signal by synthesizing the headphone down mix signal.

In accordance with a third aspect of the present invention, this object is achieved by Method of deriving a headphone down mix signal using a representation of a down mix of a multi-channel signal and using a level parameter having information on a level relation between two channels of the multi-channel signal and using head-related transfer functions related to the two channels of the multi-channel signal, the method comprising: deriving, using the level parameter, modified head-related transfer functions by weighting the head-related transfer functions of the two channels such that a modified head-related transfer function is stronger influenced by the head-related transfer function of a channel having a higher level than by the head-related transfer function of a channel having a lower level; and deriving the headphone down mix signal using the modified head-related transfer functions and the representation of the down mix signal.

In accordance with a fourth aspect of the present invention, this object is achieved by a receiver or audio player having a decoder for deriving a headphone down mix signal using a representation of a down mix of a multi-channel signal and using a level parameter having information on a level relation between two channels of the multi-channel signal and using head-related transfer functions related to the two channels of the multi-channel signal, comprising: a filter calculator for deriving modified head-related transfer functions by weighting the head-related transfer functions of the two channels using the level parameter such that a modified head-related transfer function is stronger influenced by the head-related transfer function of a channel having a higher level than by the head-related transfer function of a channel having a lower level; and a synthesizer for deriving the headphone down mix signal using the modified head-related transfer functions and the representation of the down mix signal.

In accordance with a fifth aspect of the present invention, this object is achieved by a method of receiving or audio playing, the method having a method for deriving a headphone down mix signal using a representation of a down mix of a multi-channel signal and using a level parameter having information on a level relation between two channels of the multi-channel signal and using head-related transfer functions related to the two channels of the multi-channel signal, the method comprising: deriving, using the level parameter, modified head-related transfer functions by weighting the head-related transfer functions of the two channels such that a modified head-related transfer function is stronger influenced by the head-related transfer function of a channel having a higher level than by the head-related transfer function of a channel having a lower level; and deriving the headphone down mix signal using the modified head-related transfer functions and the representation of the down mix signal.

In accordance with a sixth aspect of the present invention, this object is achieved by a decoder for deriving a spatial stereo down mix signal using a representation of a down mix of a multi-channel signal and using a level parameter having information on a level relation between two channels of the multi-channel signal and using crosstalk cancellation filters related to the two channels of the multi-channel signal, comprising: a filter calculator for deriving modified crosstalk cancellation filters by weighting the crosstalk cancellation filters of the two channels using the level parameter such that a modified crosstalk cancellation filters is stronger influenced by the crosstalk cancellation filter of a channel having a higher level than by the crosstalk cancellation filter of a channel having a lower level; and a synthesizer for deriving the spatial stereo down mix signal using the modified crosstalk cancellation filters and the representation of the down mix signal.

The present invention is based on the finding that a headphone down mix signal can be derived from a parametric down mix of a multi-channel signal, when a filter calculator is used for deriving modified HRTFs (head related transfer functions) from original HRTFs of the multi-channel signal and when the filter converter uses a level parameter having information on a level relation between two channels of the multi-channel signal such that modified HRTFs are stronger influenced by the HRTF of a channel having a higher level than by the HRTF of a channel having a lower level. Modified HRTFs are derived during the decoding process taking into account the relative strength of the channels associated to the HRTFs. The original HRTFs are modified such, that a down mix signal of a parametric representation of a multi-channel signal can be directly used to synthesize the headphone down mix signal without the need of a full parametric multi-channel reconstruction of the parametric down mix signal.

In one embodiment of the present invention, an inventive decoder is used implementing a parametric multi-channel reconstruction as well as an inventive binaural reconstruction of a transmitted parametric down mix of an original multi-channel signal. According to the present invention, a full reconstruction of the multi-channel signal prior to binaural down mixing is not required, having the obvious great advantage of a strongly reduced computational complexity. This allows, for example, mobile devices having only limited energy reservoirs to extend the playback length significantly. A further advantage is that the same device can serve as provider for complete multi-channel signals (for example 5.1, 7.1, 7.2 signals) as well as for a binaural down mix of the signal having a spatial listening experience even when using only two-speaker headphones. This might, for example, be extremely advantageous in home-entertainment configurations.

In a further embodiment of the present invention a filter calculator is used for deriving modified HRTFs not only operative to combine the HRTFs of two channels by applying individual weighting factors to the HRTF but by introducing additional phase factors for each HRTF to be combined. The introduction of the phase factor has the advantage of achieving a delay compensation of two filters prior to their superposition or combination. This leads to a combined response that models a main delay time corresponding to an intermediate position between the front and the back speakers.

A second advantage is that a gain factor, which has to be applied during the combination of the filters to ensure energy conservation, is much more stable with respect to its behavior with frequency than without the introduction of the phase factor. This is particular relevant for the inventive concept, as according to an embodiment of the present invention a representation of a down mix of a multi-channel signal is processed within a filterbank domain to derive the headphone down mix signal. As such, different frequency bands of the representation of the down mix signal are to be processed separately and therefore, a smooth behavior of the individually applied gain functions is vital.

In a further embodiment of the present invention the head-related transfer functions are converted to subband-filters for the subband domains such that the total number of modified HRTFs used in the subband domain is smaller than the total number of original HRTFs. This has the evident advantage that the computational complexity for deriving headphone down mixed signals is even decreased compared to the down mixing using standard HRTF filters.

Implementing the inventive concept allows for the use of extremely long HRTFs and thus allows for the reconstruction of headphone down mix signals based on a representation of a parametric down mix of a multi-channel signal with excellent perceptual quality.

Furthermore, using the inventive concept on crosstalk-cancellation filters allows for the generation of a spatial stereo down mix to be used with a standard 2 speaker setup based on a representation of a parametric down mix of a multi-channel signal with excellent perceptual quality.

One further big advantage of the inventive decoding concept is that a single inventive binaural decoder implementing the inventive concept may be used to derive a binaural downmix as well as a multi-channel reconstruction of a transmitted down mix taking into account the additionally transmitted spatial parameters.

In one embodiment of the present invention an inventive binaural decoder is having an analysis filterbank for deriving the representation of the down mix of the multi-channel signal in a subband domain and an inventive decoder implementing the calculation of the modified HRTFs. The decoder further comprises a synthesis filterbank to finally derive a time domain representation of a headphone down mix signal, which is ready to be played back by any conventional audio playback equipment.

In the following paragraphs, prior art parametric multi-channel decoding schemes and binaural decoding schemes are explained in more detail referencing the accompanying drawings, to more clearly outline the great advantages of the inventive concept.

Most of the embodiments of the present invention detailed below describe the inventive concept using HRTFs. As previously noted, HRTF processing is similar to the use of crosstalk-cancellation filters. Therefore, all of the embodiments are to be understood as to refer to HRTF processing as well as to crosstalk-cancellation filters. In other words, all HRTF Filters could be replaced by crosstalk-cancellation filters below to apply the inventive concept to the use of crosstalk-cancellation filters.

BRIEF DESCRIPTION OF THE DRAWINGS

Preferred embodiments of the present invention are subsequently described by referring to the enclosed drawings, wherein.

DETAILED DESCRIPTION OF PREFERRED EMBODIMENTS

The below-described embodiments are merely illustrative for the principles of the present invention for Binaural Decoding of Multi-Channel Signals By Morphed HRTF Filtering. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

In order to better outline the features and advantages of the present invention a more elaborate description of prior art will be given now.

Figure 1:
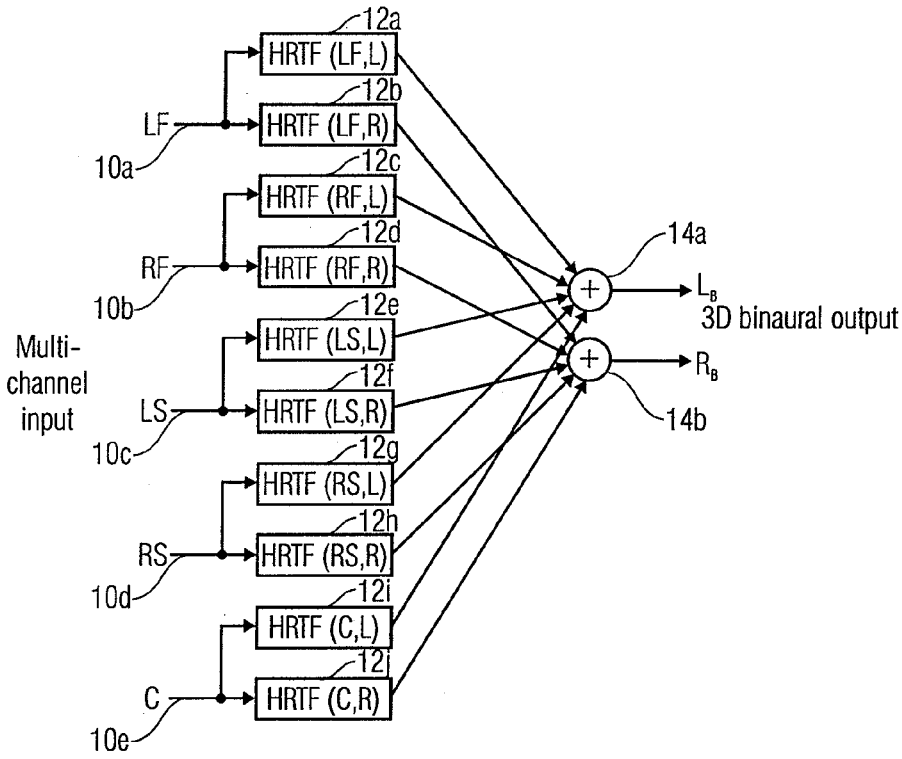
FIG. 1 shows a conventional binaural synthesis using HRTFs.

A conventional binaural synthesis algorithm is outlined in FIG. 1. A set of input channels (left front (LF), right front (RF), left surround (LS), right surround (RS) and center (C)), 10*a*, 10*b*, 10*c*, 10*d* and 10*e* is filtered by a set of HRTFs 12*a* to 12*j*. Each input signal is split into two signals (a left "L" and a right "R" component) wherein each of these signal components is subsequently filtered by an HRTF corresponding to the desired sound position. Finally, all left ear signals are summed by a summer 14*a* to generate the left binaural output signal L and the right-ear signals are summed by a summer 14*b* to generate the right binaural output signal R. It may be noted that HRTF convolution can principally be performed in the time domain, but it is often preferred to perform filtering in the frequency domain due to the increased computational efficiency. That means that, the summation shown in FIG. 1 is also performed in the frequency domain and a subsequent transformation into a time domain is additionally required.

Figure 1B:
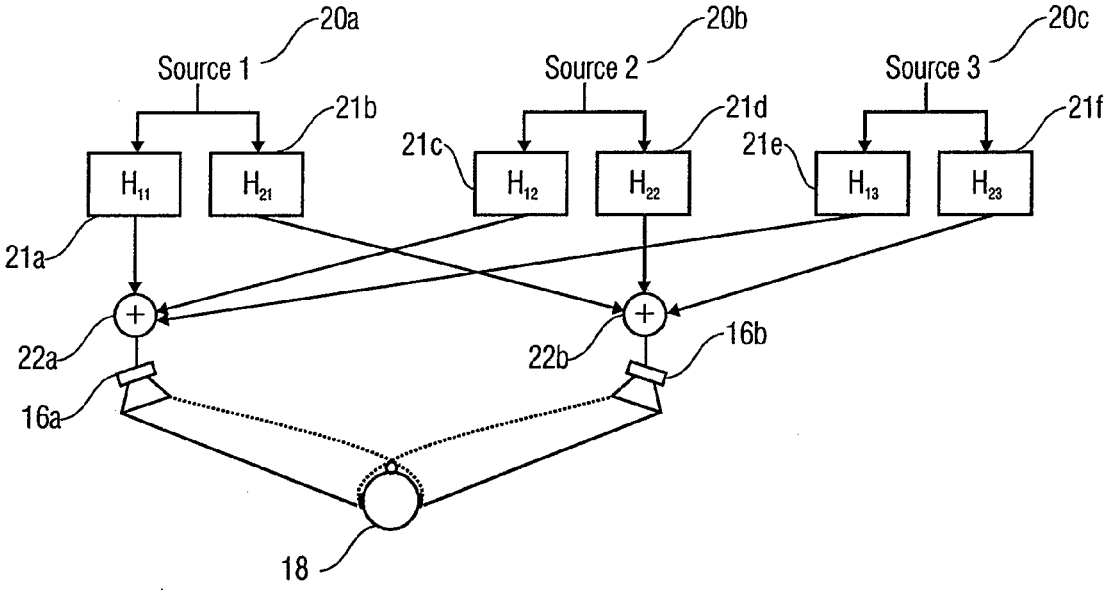
FIG. 1*b* shows a conventional use of crosstalk-cancellation filters.

FIG. 1*b* illustrates crosstalk cancellation processing intended to achieve a spatial listening impression using only two speakers of a standard stereo playback environment.

The aim is reproduction of a multi-channel signal by means of a stereo playback system having only two speakers 16*a* and 16*b* such that a listener 18 experiences a spatial listening experience. A major difference with respect to headphone reproduction is that signals of both speakers 16*a* and 16*b* directly reach both ears of listener 18. The signals indicated by dashed lines (crosstalk) therefore have to be taken into account additionally.

For ease of explanation only a 3 channel input signal having 3 sources 20*a* to 20*c* is illustrated in FIG. 1*b*. It goes without saying that the scenario can in principle be extended to arbitrary number of channels.

To derive the stereo signal to be played back, each input source is processed by 2 of the crosstalk cancellation filters 21*a* to 21*f*, one filter for each channel of the playback signal. Finally, all filtered signals for the left playback channel 16*a* and the right playback channel 16*b* are summed up for playback. It is evident that the crosstalk cancellation filters will in general be different for each source 20*a* and 20*b* (depending on its desired perceived position) and that they could furthermore even depend on the listener.

Owing to the high flexibility of the inventive concept, one benefits from high flexibility in the design and application of the crosstalk cancellation filters such that filters can be optimized for each application or playback device individually. One further advantage is that the method is computationally extremely efficient, since only 2 synthesis filterbanks are required.

Figure 2:
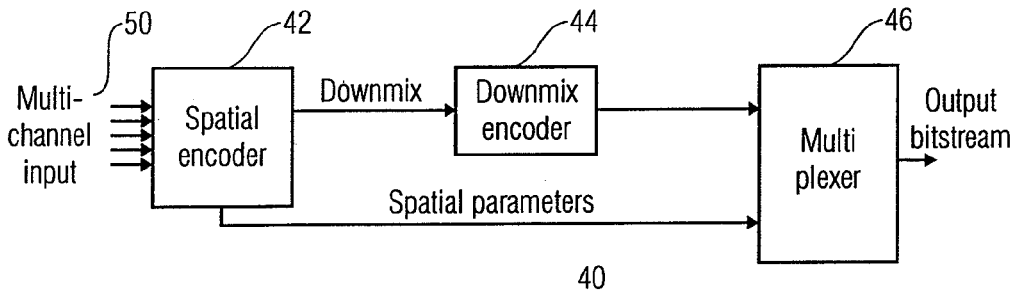
FIG. 2 shows an example of a multi-channel spatial encoder.

A principle sketch of a spatial audio encoder is shown in FIG. 2. In such a basic encoding scenario, a spatial audio decoder 40 comprises a spatial encoder 42, a down mix encoder 44 and a multiplexer 46.

A multi-channel input signal 50 is analyzed by the spatial encoder 42, extracting spatial parameters describing spatial properties of the multi-channel input signal that have to be transmitted to the decoder side. The down mixed signal generated by the spatial encoder 42 may for example be a monophonic or a stereo signal depending on different encoding scenarios. The down mix encoder 44 may then encode the monophonic or stereo down mix signal using any conventional mono or stereo audio coding scheme. The multiplexer 46 creates an output bit stream by combining the spatial parameters and the encoded down mix signal into the output bit stream.

Figure 3:
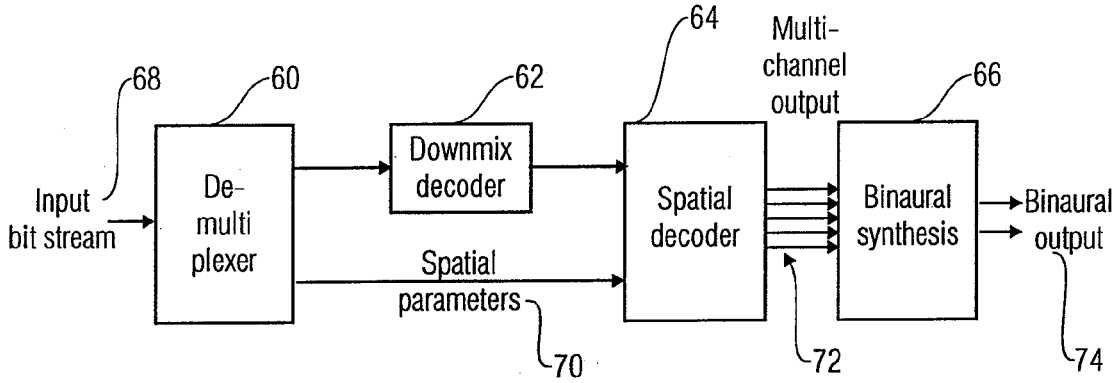
FIG. 3 shows an example for prior art spatial/binaural-decoders.

FIG. 3 shows a possible direct combination of a multi-channel decoder corresponding to the encoder of FIG. 2 and a binaural synthesis method as, for example, outlined in FIG. 1. As can be seen, the prior art approach of combining the features is simple and straight forward. The set-up comprises a de-multiplexer 60, a down mix decoder 62, a spatial decoder 64 and a binaural synthesizer 66. An input bit stream 68 is de-multiplexed resulting in spatial parameters 70 and a down mix signal bit stream. The latter down-mix signal bit stream is decoded by the down mix decoder 62 using a conventional mono or stereo decoder. The decoded down mix is input, together with the spatial parameters 70, into the spatial decoder 64 that generates a multi-channel output signal 72 having the spatial properties indicated by the spatial parameters 70. Having a multi-channel signal 72 completely reconstructed, the approach of simply adding a binaural synthesizer 66 to implement the binaural synthesis concept of FIG. 1 is straight-forward. Therefore, the multi-channel output signal 72 is used as an input for the binaural synthesizer 66 which processes the multi-channel output signal to derive the resulting binaural output signal 74. The approach shown in FIG. 3 has at least three disadvantages:

- a complete multi-channel signal representation has to be computed as an intermediate step, followed by HRTF convolution and down mixing in the binaural synthesis. Although HRTF convolution should be performed on a per channel basis, given the fact that each audio channel can have a different spatial position, this is an undesirable situation from a complexity point of view. Thus, computational complexity is high and energy is wasted.
- The spatial decoder operates in a filterbank (QMF) domain. HRTF convolution, on the other hand, is typically applied in the FFT domain. Therefore, a cascade of a multi-channel QMF synthesis filterbank, a multi-channel DFT transform, and a stereo inverse DFT transform is necessary, resulting in a system with high computational demands.
- Coding artefacts created by the spatial decoder to create a multi-channel reconstruction will be audible, and possibly enhanced in the (stereo) binaural output.

Figure 4:
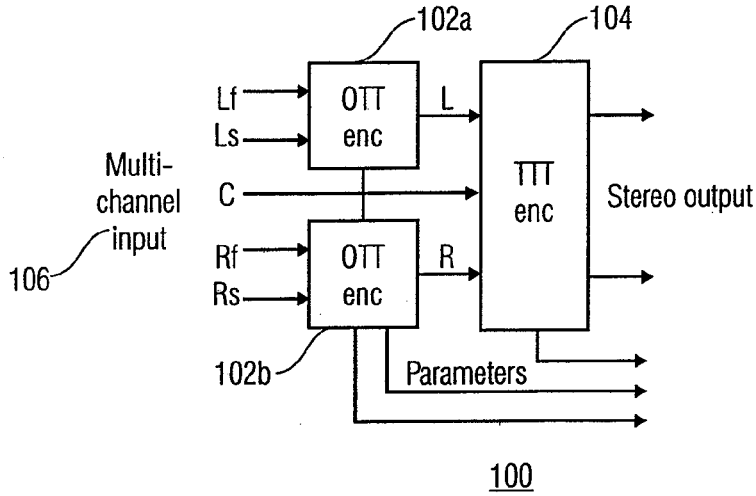
FIG. 4 shows an example of a parametric multi-channel encoder.
Figure 5:
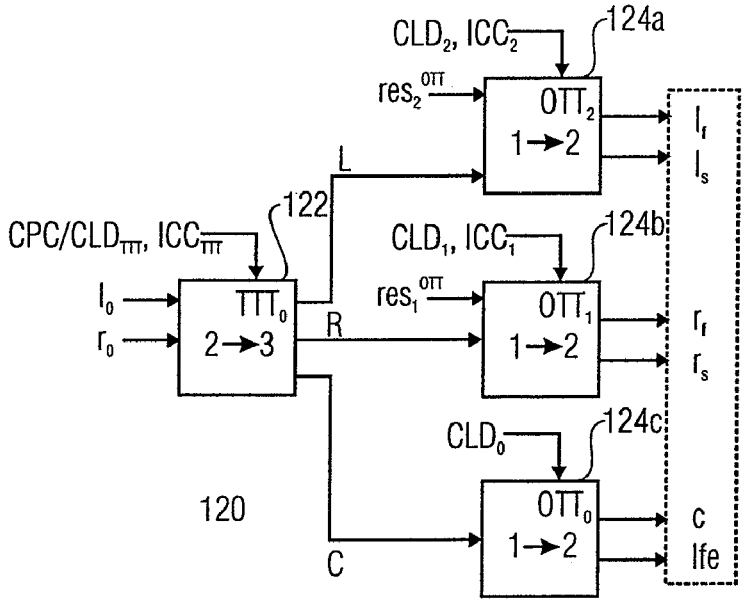
FIG. 5 shows an example of a parametric multi-channel decoder.

An even more detailed description of multi-channel encoding and decoding is given in FIGS. 4 and 5.

The spatial encoder 100 shown in FIG. 4 comprises a first OTT (1-to-2-encoder) 102*a*, a second OTT 102*b* and a TTT box (3-to-2-encoder) 104. A multi-channel input signal 106 consisting of LF, LS, C, RF, RS (left-front, left-surround, center, right-front and right-surround) channels is processed by the spatial encoder 100. The OTT boxes receive two input audio channels each, and derive a single monophonic audio output channel and associated spatial parameters, the parameters having information on the spatial properties of the original channels with respect to one another or with respect to the output channel (for example CLD, ICC, parameters). In the encoder 100, the LF and the LS channels are processed by OTT encoder 102*a* and the RF and RS channels are processed by the OTT encoder 102*b*. Two signals, L and R are generated, the one only having information on the left side and the other only having information on the right side. The signals L, R and C are further processed by the TTT encoder 104, generating a stereo down mix and additional parameters.

The parameters resulting from the TTT encoder typically consist of a pair of prediction coefficients for each parameter band, or a pair of level differences to describe the energy ratios of the three input signals. The parameters of the 'OTT' encoders consist of level differences and coherence or cross-correlation values between the input signals for each frequency band.

It may be noted that although the schematic sketch of the spatial encoder 100 points to a sequential processing of the individual channels of the down mix signal during the encoding, it is also possible to implement the complete down mixing process of the encoder 100 within one single matrix operation.

FIG. 5 shows a corresponding spatial decoder, receiving as an input the down mix signals as provided by the encoder of FIG. 4 and the corresponding spatial parameters.

The spatial decoder 120 comprises a 2-to-3-decoder 122 and 1-to-2-decoders 124*a* to 124*c*. The down mix signals $L_0$ and $R_0$ are input into the 2-to-3-decoder 122 that recreates a center channel C, a right channel R and a left channel L. These three channels are further processed by the OTT-decoders 124*a* to 124*c* yielding six output channels. It may be noted that the derivation of a low-frequency enhancement channel LFE is not mandatory and can be omitted such that one single OTT-encoder may be saved within the surround decoder 120 shown in FIG. 5.

Figure 6:
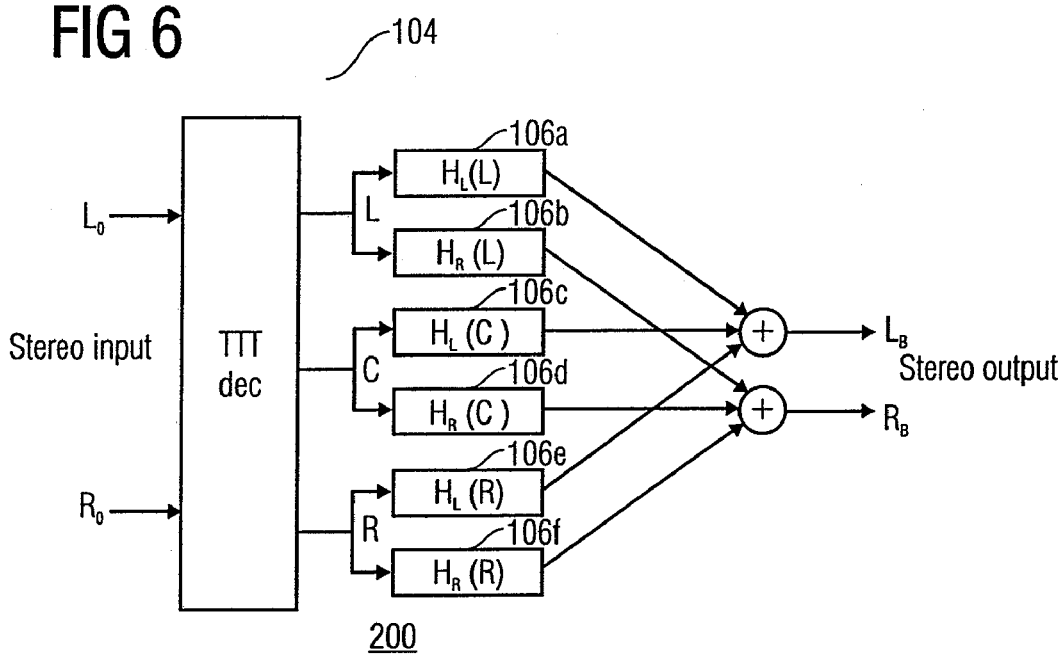
FIG. 6 shows an example of an inventive decoder.

According to one embodiment of the present invention the inventive concept is applied in a decoder as shown in FIG. 6. The inventive decoder 200 comprises a 2-to-3-decoder 104 and six HRTF-filters 106*a* to 106*f*. A stereo input signal ($L_0$, $R_0$) is processed by the TTT-decoder 104, deriving three signals L, C and R. It may be noted, that the stereo input signal is assumed to be delivered within a subband domain, since the TTT-encoder may be the same encoder as shown in FIG. 5 and hence adapted to be operative on subband signals. The signals L, R and C are subject to HRTF parameter processing by the HRTF filters 106*a* to 106*f*.

The resulting 6 channels are summed to generate the stereo binaural output pair ($L_b$, $R_b$).

The TTT decoder, 106, can be described as the following matrix operation:

$$\begin{bmatrix} L \\ R \\ C \end{bmatrix} = \begin{bmatrix} m_{11} & m_{12} \\ m_{21} & m_{22} \\ m_{31} & m_{32} \end{bmatrix} \begin{bmatrix} L_0 \\ R_0 \end{bmatrix},$$

with matrix entries $m_{xy}$ dependent on the spatial parameters. The relation of spatial parameters and matrix entries is identical to those relations as in the 5.1-multichannel MPEG surround decoder. Each of the three resulting signals L, R, and C are split in two and processed with HRTF parameters corresponding to the desired (perceived) position of these sound sources. For the center channel (C), the spatial parameters of the sound source position can be applied directly, resulting in two output signals for the center, $L_B(C)$ and $R_B(C)$:

$$\begin{bmatrix} L_B(C) \\ R_B(C) \end{bmatrix} = \begin{bmatrix} H_L(C) \\ H_R(C) \end{bmatrix} C.$$

For the left (L) channel, the HRTF parameters from the left-front and left-surround channels are combined into a single HRTF parameter set, using the weights $w_{lf}$ and $w_{rf}$. The resulting 'composite' HRTF parameters simulate the effect of both the front and surround channels in a statistical sense. The following equations are used to generate the binaural output pair ($L_B$, $R_B$) for the left channel:

$$\begin{bmatrix} L_B(L) \\ R_B(L) \end{bmatrix} = \begin{bmatrix} H_L(L) \\ H_R(L) \end{bmatrix} L,$$

In a similar fashion, the binaural output for the right channel is obtained according to:

$$\begin{bmatrix} L_B(R) \\ R_B(R) \end{bmatrix} = \begin{bmatrix} H_L(R) \\ H_R(R) \end{bmatrix} R,$$

Given the above definitions of $L_B(C)$, $R_B(C)$, $L_B(L)$, $R_B(L)$, $L_B(R)$ and $R_B(R)$, the complete $L_B$ and $R_B$ signals can be derived from a single 2 by 2 matrix given the stereo input signal:

$$\begin{bmatrix} L_B \\ R_B \end{bmatrix} = \begin{bmatrix} h_{11} & h_{12} \\ h_{21} & h_{22} \end{bmatrix} \begin{bmatrix} L_0 \\ R_0 \end{bmatrix},$$

with $$h_{11}=m_{11}H_L(L)+m_{21}H_L(R)+m_{31}H_L(C),$$

$$h_{12}=m_{12}H_L(L)+m_{22}H_L(R)+m_{32}H_L(C)$$

$$h_{21}=m_{11}H_R(L)+m_{21}H_R(R)+m_{31}H_R(C)$$

$$h_{22}=m_{12}H_R(L)+m_{22}H_R(R)+m_{32}H_R(C).$$

In the above it was assumed that the $H_Y(X)$ elements, for $Y=L_0,R_0$ and X=L,R,C, were complex scalars. However, the present invention teaches how to extend the approach of a 2 by 2 matrix binaural decoder to handle arbitrary length HRTF filters. In order to achieve this, the present invention comprises the following steps:

- Transform the HRTF filter responses to a filterbank domain;
- Overall delay difference or phase difference extraction from HRTF filter pairs;
- Morph the responses of the HRTF filter pair as a function of the CLD parameters
- Gain adjustment This is achieved by replacing the six complex gains $H_Y(X)$ for $Y=L_0,R_0$ and X=L,R,C with six filters. These filters are derived from the ten filters $H_Y(X)$ for $Y=L_0,R_0$ and X=Lf,Ls, Rf,Rs,C, which describe the given HRTF filter responses in the QMF domain. These QMF representations can be achieved according to the method described in one of the subsequent paragraphs.

In other words, the present invention teaches a concept for deriving modified HRTFs as by modifying (morphing) of the front end surround channel filters using a complex linear combination according to $$H_Y(X)=gw_f\exp(-j\phi_{XY}w_s^2)H_Y(Xf)+gw_s\exp(j\phi_{XY}w_f^2)H_Y(Xs).$$

As it can be seen from the above formula, deriving of the modified HRTFs is a weighted superposition of the original HRTFs, additionally applying phase factors. The weights $w_s$, $w_f$ depend on the CLD parameters intended to be used by the OTT decoders 124*a* and 124*b* of FIG. 5.

The weights $w_{lf}$ and $w_{ls}$ depend on the CLD parameter of the 'OTT' box for Lf and Ls:

$$w_{lf}^2 = \frac{10^{CLD_l/10}}{1+10^{CLD_l/10}},$$

$$w_{ls}^2 = \frac{1}{1+10^{CLD_l/10}}.$$

The weights $w_{rf}$ and $w_{rs}$ depend on the CLD parameter of the 'OTT' box for Rf and Rs:

$$w_{rf}^2 = \frac{10^{CLD_r/10}}{1+10^{CLD_r/10}},$$

$$w_{rs}^2 = \frac{1}{1+10^{CLD_r/10}}.$$

The phase parameter $\phi_{XY}$ can be derived from the main delay time difference $\tau_{XY}$ between the front and back HRTF filters and the subband index n of the QMF bank:

$$\phi_{XY} = \frac{\pi\left(n+\frac{1}{2}\right)}{64}\tau_{XY}.$$

The role of this phase parameter in the morphing of filters is twofold. First, it realizes a delay compensation of the two filters prior to superposition which leads to a combined response which models a main delay time corresponding to a source position between the front and the back speakers. Second, it makes the necessary gain compensation factor g much more stable and slowly varying over frequency than in the case of simple superposition with $\phi_{XY}=0$.

The gain factor g is determined by the incoherent addition power rule, $$P_Y(X)^2=w_f^2P_Y(Xf)^2+w_s^2P_Y(Xs)^2,$$

where $$P_Y(X)^2=g^2(w_f^2P_Y(Xf)^2+w_s^2P_Y(Xs)^2+2w_fw_sP_Y(Xf)P_Y(Xs)\rho_{XY})$$

and $\rho_{XY}$ is the real value of the normalized complex cross correlation between the filters $$\exp(-j\phi_{XY})H_Y(Xf) \text{ and } H_Y(Xs).$$

For the above equations, P denotes a parameter describing an average level per frequency band for the impulse response of the filter specified by the indexes. This mean intensity is of course easily derived, once the filter response function are known.

In the case of simple superposition with $\phi_{XY}=0$, the value of $\rho_{XY}$ varies in an erratic and oscillatory manner as a function of frequency, which leads to the need for extensive gain adjustment. In practical implementation it is necessary to limit the value of the gain g and a remaining spectral colorization of the signal cannot be avoided.

In contrast, the use of morphing with a delay based phase compensation as taught by the present invention leads to a smooth behaviour of $\rho_{XY}$ as a function of frequency. This value is often even close to one for natural HRTF derived filter pairs since they differ mainly in delay and amplitude, and the purpose of the phase parameter is to take the delay difference into account in the QMF filterbank domain.

An alternative beneficial choice of phase parameter $\phi_{XY}$ taught by the present invention is given by the phase angle of the normalized complex cross correlation between the filters $$H_Y(Xf) \text{ and } H_Y(Xs),$$

and unwrapping the phase values with standard unwrapping techniques as a function of the subband index n of the QMF bank. This choice has the consequence that $\rho_{XY}$ is never negative and hence the compensation gain g satisfies $1/\sqrt{2} \leqq g \leqq 1$ for all subbands. Moreover this choice of phase parameter enables the morphing of the front and surround channel filters in situations where a main delay time difference $\tau_{XY}$ is not available.

For the embodiment of the present invention as described above, it is taught to accurately transform the HRTFs into an efficient representation of the HRTF filters within the QMF domain.

Figure 7:
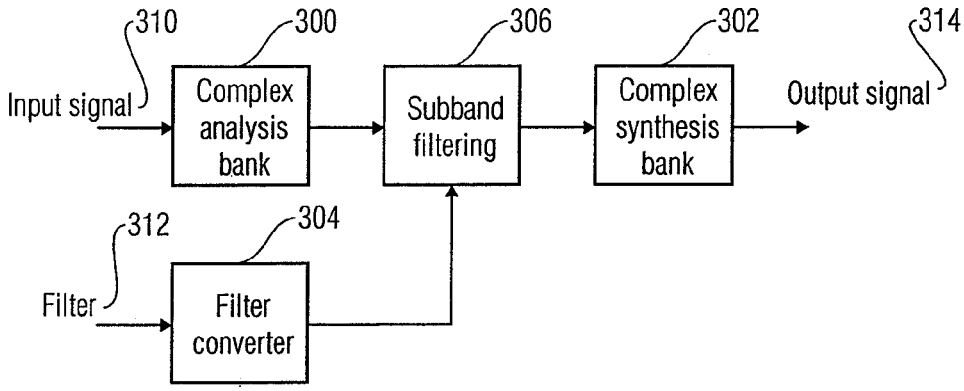
FIG. 7 shows a block diagram illustrating the concept of transforming filters into the subband domain.

FIG. 7 gives a principle sketch of the concept to accurately transform time-domain filters into filters within the subband domain having the same net effect on a reconstructed signal. FIG. 7 shows a complex analysis bank 300, a synthesis bank 302 corresponding to the analysis bank 300, a filter converter 304 and a subband filter 306.

An input signal 310 is provided for which a filter 312 is known having desired properties. The aim of the implementation of the filter converter 304 is that the output signal 314 has the same characteristics after analysis by the analysis filterbank 300, subsequent subband filtering 306 and synthesis 302 as if it would have when filtered by filter 312 in the time domain. The task of providing a number of subband filters corresponding to the number of subbands used is fulfilled by filter converter 304.

The following description outlines a method for implementing a given FIR filter h(v) in the complex QMF subband domain. The principle of operation is shown in FIG. 7.

Here, the subband filtering is simply the application of one complex valued FIR filter for each subband, n=0, 1, . . . , L−1 to transform the original indices $c_n$ into their filtered counterparts $d_n$ according to the following formula:

$$d_n(k) = \sum_l g_n(l) c_n(k-l).$$

Observe that this is different from well known methods developed for critically sampled filterbanks, since those methods require multiband filtering with longer responses. The key component is the filter converter, which converts any time domain FIR filter into the complex subband domain filters. Since the complex QMF subband domain is oversampled, there is no canonical set of subband filters for a given time domain filter. Different subband filters can have the same net effect of the time domain signal. What will be described here is a particularly attractive approximate solution, which is obtained by restricting the filter converter to be a complex analysis bank similar to the QMF.

Assuming that the filter converter prototype is of length $64K_Q$, a real $64K_H$ tap FIR filter is transformed into a set of 64 complex $K_H+K_Q-1$ tap subband filters. For $K_Q=3$, a FIR filter of 1024 taps is converted into 18 tap subband filtering with an approximation quality of 50 dB.

The subband filter taps are computed from the formula $$g_n(k) = \sum_{v=-\infty}^{\infty} h(v+kL) q(v) \exp\left(-i\frac{\pi}{L}\left(n+\frac{1}{2}\right)v\right),$$

where q(v) is a FIR prototype filter derived from the QMF prototype filter. As it can be seen, this is just a complex filterbank analysis of the given filter h(v).

In the following, the inventive concept will be outlined for a further embodiment of the present invention, where a multi-channel parametric representation for a multi-channel signal having five channels is available. Please note that in this particular embodiment of the present invention, original 10 HRTF filters $V_{Y,X}$ (as for example given by a QMF representation of the filters 12*a* to 12*j* of FIG. 1) are morphed into six filters $h_{v,x}$ for Y=L,R and X=L,R,C.

The ten filters $v_{Y,X}$ for Y=L,R and X=FL,BL,FR,BR,C describe the given HRTF filter responses in a hybrid QMF domain.

The combination of the front and surround channel filters is performed with a complex linear combination according to $$h_{L,C}=v_{L,C}$$

$$h_{R,C}=v_{R,C}$$

$$h_{L,L}=g_{L,L}\sigma_{FL}\exp(-j\phi_{FL,BL}{}^{L}\sigma_{BR}{}^{2})v_{L,FL}+g_{L,L}\sigma_{BL}\exp(j\phi_{FL,BL}{}^{L}\sigma_{FL}{}^{2})v_{L,BL}$$

$$h_{L,R}=g_{L,R}\sigma_{FR}\exp(-j\phi_{FR,BR}{}^{L}\sigma_{BR}{}^{2})v_{L,FR}+g_{L,R}\sigma_{BR}\exp(j\phi_{FR,BR}{}^{L}\sigma_{FR}{}^{2})v_{L,BR}$$

$$h_{R,L}=g_{R,L}\sigma_{FL}\exp(-j\phi_{FL,BL}{}^{R}\sigma_{BL}{}^{2})v_{R,FL}+g_{R,L}\sigma_{BL}\exp(j\phi_{FL,BL}{}^{R}\sigma_{FL}{}^{2})v_{R,BL}$$

$$h_{R,R}=g_{R,R}\sigma_{FR}\exp(-j\phi_{FR,BR}{}^{R}\sigma_{BR}{}^{2})v_{R,FR}+g_{R,R}\sigma_{BR}\exp(j\phi_{FR,BR}{}^{R}\sigma_{FR}{}^{2})v_{R,BR}$$

The gain factors $g_{L,L}, g_{L,R}, g_{R,L}, g_{R,R}$ are determined by $$g_{Y,X} = \left(\frac{\sigma_{FX}^2 CFB_{Y,X}^2 + \sigma_{BK}^2}{\sigma_{FX}^2 CFB_{Y,X}^2 + \sigma_{BX}^2 + 2\sigma_{FX}\sigma_{BX} CFB_{Y,X} ICCFB_{Y,X}^{\phi}}\right)^{1/2}$$

The parameters $CFB_{Y,X}$, $ICCFB_{Y,X}{}^{\Phi}$ and the phase parameters $\phi$ are defined as follows:

An average front/back level quotient per hybrid band for the HRTF filters is defined for Y=L,R and X=L,R by $$(CFB_{Y,X})_k = \left(\frac{\sum_{l=0}^{L_q-1} |(V_{Y,FX})_k(l)|^2}{\sum_{l=0}^{L_q-1} |(v_{Y,BX})_k(l)|^2}\right)^{1/2}.$$

Furthermore, phase parameters $\phi_{FL,BL}{}^{L}, \phi_{FR,BR}{}^{L}, \phi_{FL,BL}{}^{R}, \phi_{FR,BR}{}^{R}$ are then defined for Y=L,R and X=L,R by $$(CIC_{Y,X})_k = |(CIC_{Y,X})_k| \exp(j(\phi_{FX,BX}{}^{Y})_k),$$

where the complex cross correlations $(CIC_{Y,X})_k$ are defined by $$(CIC_{Y,X})_k = \frac{\sum_{l=0}^{L_q-1} (v_{Y,FX})_k(l)(v_{Y,BX})_k^*(l)}{\left(\sum_{l=0}^{L_q-1} |(v_{Y,FX})_k(l)|^2\right)^{1/2}\left(\sum_{l=0}^{L_q-1} |(v_{Y,BX})_k(l)|^2\right)^{1/2}}.$$

A phase unwrapping is applied to the phase parameters along the subband index k, such that the absolute value of the phase increment from subband k to subband k+1 is smaller or equal to π for k=0,1, . . . . In cases where there are two choices, ±π, for the increment, the sign of the increment for a phase measurement in the interval ]−π,π] is chosen. Finally, normalized phase compensated cross correlations are defined for Y=L,R and X=L,R by $$(ICCFB_{Y,X}^{\Phi})_k = |(CIC_{Y,X})_k|.$$

Please note that in the case where the multi-channel processing is performed within a hybrid subband domain, i.e. in a domain where subbands are further decomposed into different frequency bands, a mapping of the HRTF responses to the hybrid band filters may for example be performed as follows:

As in the case without an hybrid filterbank, the ten given HRTF impulse responses from source X=FL,BL,FR,BR,C to target Y=L,R are all converted into QMF subband filters according to the method outlined above. The result is the ten subband filters $\hat{v}_{Y,X}$ with components $$(\hat{v}_{Y,X})_m(l)$$

for QMF subband m=0, 1, . . . , 63 and QMF time slot l=0, 1, . . . , $L_q-1$. Let the index mapping from the hybrid band k to QMF band m be denoted by m=Q(k).

Then the HRTF filters $v_{Y,X}$ in the hybrid band domain are defined by $$(v_{Y,X})_k(l) = (\hat{v}_{Y,X})_{Q(k)}(l).$$

For the specific embodiment described in the previous paragraphs, the filter conversion of HRTF filters into the QMF domain can be implemented as follows, given a FIR filter h(v) of length $N_h$ to be transferred to the complex QMF subband domain:

The subband filtering consists of the separate application of one complex valued FIR filter $h_m(l)$ for each QMF subband, m=0, 1, . . . , 63. The key component is the filter converter, which converts the given time domain FIR filter h(v) into the complex subband domain filters $h_m(l)$. The filter converter is a complex analysis bank similar to the QMF analysis bank. Its prototype filter q(v) is of length 192. An extension with zeros of the time domain FIR filter is defined by $$\tilde{h}(v) = \begin{cases} h(v), & v = 0, 1, \ldots, N_k - 1; \\ 0, & \text{otherwise}, \end{cases}$$

The subband domain filters of length, $L_q = K_h + 2$ where $K_h = \lceil N_h/64 \rceil$ is then given for m=0, 1, . . . , 63 and l=0, 1, . . . , $K_h+1$ by $$h_m(l) = \sum_{v=0}^{191} \tilde{h}(v + 64(l-2))q(v)\exp\left(-j\frac{\pi}{64}\left(m + \frac{1}{2}\right)(v - 95)\right).$$

Although the inventive concept has been detailed with respect to a down mix signal having two channels, i.e. a transmitted stereo signal, the application of the inventive concept is by no means restricted to a scenario having a stereo-down mix signal.

Summarizing, the present invention relates to the problem of using long HRTF or crosstalk cancellation filters for binaural rendering of parametric multi-channel signals. The invention teaches new ways to extend the parametric HRTF approach to arbitrary length of HRTF filters.

The present invention comprises the following features:

- Multiplying the stereo down mix signal by a 2 by 2 matrix where every matrix element is a FIR filter or arbitrary length (as given by the HRTF filter);
- Deriving the filters in the 2 by 2 matrix by morphing the original HRTF filters based on the transmitted multi-channel parameters;
- Calculation of the morphing of the HRTF filters so that the correct spectral envelope and overall energy is obtained.

Figure 8:
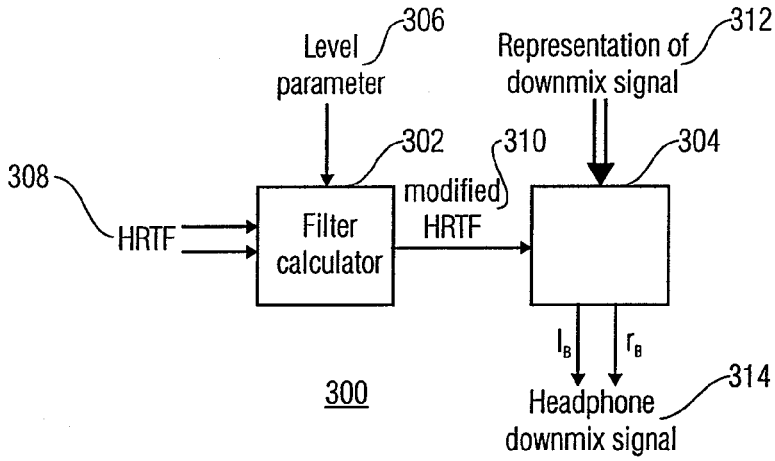
FIG. 8 shows an example of an inventive decoder.

FIG. 8 shows an example for an inventive decoder 300 for deriving a headphone down mix signal. The decoder comprises a filter calculator 302 and a synthesizer 304. The filter calculator receives as a first input level parameters 306 and as a second input HRTFs (head-related transfer functions) 308 to derive modified HRTFs 310 that have the same net effect on a signal when applied to the signal in the subband domain than the head-related transfer functions 308 applied in the time domain. The modified HRTFs 310 serve as first input to the synthesizer 304 that receives as a second input a representation of a down-mix signal 312 within a subband domain. The representation of the down-mix signal 312 is derived by a parametric multi-channel encoder and intended to be used as a basis for reconstruction of a full multi-channel signal by a multi-channel decoder. The synthesizer 404 is thus able to derive a headphone down-mix signal 314 using the modified HRTFs 310 and the representation of the down-mix signal 312.

It may be noted, that the HRTFs could be provided in any possible parametric representation, for example as the transfer function associated to the filter, as the impulse response of the filter or as a series of tap coefficients for an FIR-filter.

Figure 9:
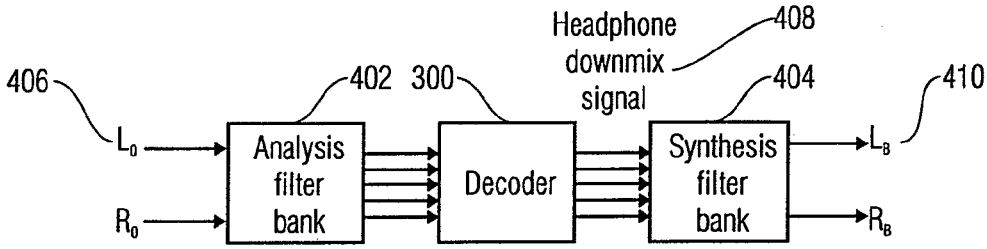
FIG. 9 shows a further example of an inventive decoder.

The previous examples assume, that the representation of the down-mix signal is already supplied as a filterbank representation, i.e. as samples derived by a filterbank. In practical applications, however, a time-domain down-mix signal is typically supplied and transmitted to allow also for a direct playback of the submitted signal in simple playback environments. Therefore, in FIG. 9 in a further embodiment of the present invention, where a binaural compatible decoder 400 comprises an analysis filterbank 402 and a synthesis filterbank 404 and an inventive decoder, which could, for example, be the decoder 300 of FIG. 8. Decoder functionalities and their descriptions are applicable in FIG. 9 as well as in FIG. 8 and the description of the decoder 300 will be omitted within the following paragraph.

The analysis filterbank 402 receives a downmix of a multi-channel signal 406 as created by a multi-channel parametric encoder. The analysis filterbank 402 derives the filterbank representation of the received down mix signal 406 which is then input into decoder 300 that derives a headphone downmix signal 408, still within the filterbank domain. That is, the down mix is represented by a multitude of samples or coefficients within the frequency bands introduced by the analysis filterbank 402. Therefore, to provide a final headphone down mix signal 410 in the time domain the headphone downmix signal 408 is input into synthesis filterbank 404 that derives the headphone down mix signal 410, which is ready to be played back by stereo reproduction equipment.

Figure 10:
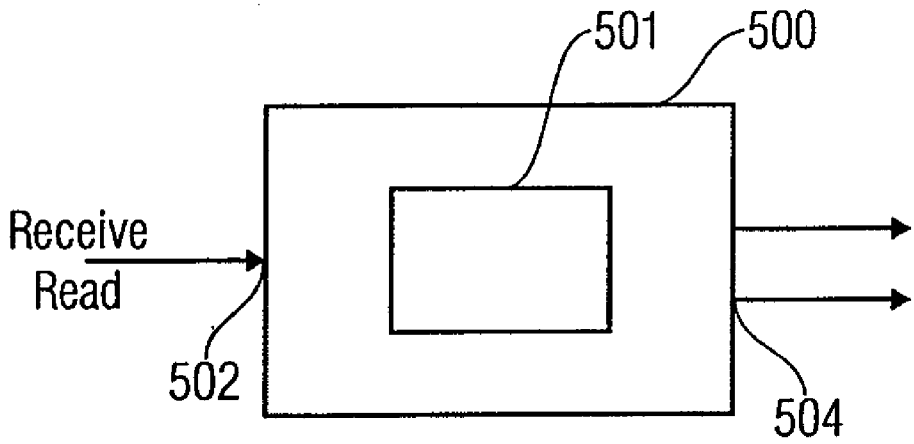
FIG. 10 shows an example for an inventive receiver or audio player.

FIG. 10 shows an inventive receiver or audio player 500, having an inventive audio decoder 501, a bit stream input 502, and an audio output 504.

A bit stream can be input at the input 502 of the inventive receiver/audio player 500. The bit stream then is decoded by the decoder 501 and the decoded signal is output or played at the output 504 of the inventive receiver/audio player 500.

Although examples have been derived in the preceding paragraphs to implement the inventive concept relying on a transmitted stereo down mix, the inventive concept may also be applied in configurations based on a single monophonic down mix channel or on more than two down mix channels.

One particular implementation of the transfer of head-related transfer functions into the subband domain is given in the description of the present invention. However, other techniques of deriving the subband filters may also be used without limiting the inventive concept.

The phase factors introduced in the derivation of the modified HRTFs can be derived also by other computations than the ones previously presented. Therefore, deriving those factors in a different way does not limit the scope of the invention.

Even as the inventive concept is shown particularly for HRTF and crosstalk cancellation filters, it can be used for other filters defined for one or more individual channels of a multi channel signal to allow for a computationally efficient generation of a high quality stereo playback signal. The filters are furthermore not only restricted to filters intended to model a listening environment. Even filters adding "artificial" components to a signal can be used, such as for example reverberation or other distortion filters.

Depending on certain implementation requirements of the inventive methods, the inventive methods can be implemented in hardware or in software. The implementation can be performed using a digital storage medium, in particular a disk, DVD or a CD having electronically readable control signals stored thereon, which cooperate with a programmable computer system such that the inventive methods are performed. Generally, the present invention is, therefore, a computer program product with a program code stored on a machine readable carrier, the program code being operative for performing the inventive methods when the computer program product runs on a computer. In other words, the inventive methods are, therefore, a computer program having a program code for performing at least one of the inventive methods when the computer program runs on a computer.

While the foregoing has been particularly shown and described with reference to particular embodiments thereof, it will be understood by those skilled in the art that various other changes in the form and details may be made without departing from the spirit and scope thereof. It is to be understood that various changes may be made in adapting to different embodiments without departing from the broader concepts disclosed herein and comprehended by the claims that follow.

What is claimed is:

1. Decoder for deriving a headphone down mix signal using a representation of a down mix of a multi-channel signal and using a level parameter having information on a level relation between two channels of the multi-channel signal and using head-related transfer functions related to the two channels of the multi-channel signal, comprising:

a filter calculator for deriving modified head-related transfer functions by weighting the head-related transfer functions of the two channels using the level parameter such that a modified head-related transfer function is stronger influenced by the head-related transfer function of a channel having a higher level than by the head-related transfer function of a channel having a lower level and that a phase compensation of the head-related transfer functions of the two channels is achieved prior to a combination of weighted and phase-compensated head-related transfer functions of the two channels; and a synthesizer for deriving the headphone down mix signal using the modified head-related transfer functions and the representation of the down mix signal.

2. Decoder in accordance with claim 1, in which the filter calculator is operative to derive the modified head-related transfer functions further applying phase factors to the head-related transfer functions of the two channels such that the head-related transfer function of a channel having a lower level is shifted closer to a mean phase of the head-related transfer functions of the two channels than a channel having a higher level.

3. Decoder in accordance with claim 1 in which the filter calculator is operative such that the number of modified head-related transfer functions derived is smaller than the number of associated head-related transfer functions of the two channels.

4. Decoder in accordance with claim 1 in which the filter calculator is operative to derive modified head-related transfer functions adapted to be applied to a filterbank representation of the down mix signal.

5. Decoder in accordance with claim 1, adapted to use a representation of the down mix signal derived in a filterbank domain.

6. Decoder in accordance with claim 1, in which the filter calculator is operative to derive modified head-related transfer functions using head-related transfer functions characterized by more than three parameters.

7. Decoder in accordance with claim 1, in which the filter calculator is operative to derive the weighting factors for the head-related trans-fer functions of the two channels using the same level parameter.

8. Decoder in accordance with claim 7, in which the filter calculator is operative to derive a first weighting factor $w_{lf}$ for a first channel f and a second weighting factor $w_{ls}$ for a second channel s using the level parameter $CLD_1$ according to the following formulas:

$$w_{lf}^2 = \frac{10^{CLD_l/10}}{1 + 10^{CLD_l/10}},$$

$$w_{ls}^2 = \frac{1}{1 + 10^{CLD_l/10}}.$$

9. Decoder in accordance with claim 1, in which the filter calculator is operative to derive the modified head-related transfer functions applying a common gain factor to the head-related transfer functions of the two channels such that energy is preserved when deriving the modified head-related transfer functions.

10. Decoder in accordance with claim 9, in which the common gain factor is within the interval $[1/\sqrt{2},1]$.

11. Decoder in accordance with claim 2, in which the filter calculator is operative to derive the phase factors using a delay time between impulse responses of head-related transfer functions of the two channels.

12. Decoder in accordance with claim 11, in which the filter calculator is operative in a filterbank domain having L frequency bands and to derive individual mean phase shifts for each frequency band using the delay time.

13. Decoder in accordance with claim 11, in which the filter calculator is operative in a filterbank domain having more than 2 frequency bands and to derive individual phase parameters $\Phi_{XY}$ for each frequency band n using the delay time $\tau_{XY}$ according to the following formula:

$$\phi_{XY} = \frac{\pi\left(n + \frac{1}{2}\right)}{64}\tau_{XY}.$$

14. Decoder in accordance with claim 2, in which the filter calculator is operative to derive the phase factor using the phase angle of the normalized complex cross correlation between the impulse responses of head-related transfer functions of the first and the second channel.

15. Decoder in accordance with claim 1, in which the first channel of the two channels is a front channel of the left or the right side of the multi-channel signal and the second channel of the two channels is a back channel of the same side.

16. Decoder in accordance with claim 15, in which the filter calculator is operative to derive the modified head-related trans-fer function $H_y(X)$ using the front channel head-related transfer function $H_y(Xf)$ and the back channel head-related transfer function $H_y(Xs)$ using the following complex linear combination:

$$H_y(X)=gw_f\exp(-j\phi_{XY}w_s^2)H_y(Xf)+gw_s\exp(j\phi_{XY}w_f^2)H_y(Xs),$$ wherein $\Phi_{XY}$ is a phase parameter, $w_s$ and $w_f$ are weighting factors derived using the level parameter and g is a common gain factor derived using the level parameter.

17. Decoder in accordance with claim 1, adapted to use a representation of a down mix signal having a left and a right channel derived from a multi-channel signal having a left-front, a left-surround, a rightfront, a right-surround and a center channel.

18. Decoder in accordance with claim 1, in which the synthesizer is operative to derive channels of the headphone down mix signal applying a linear combination of the modified head-related transfer functions to the representation of the down mix of the multi-channel signal.

19. Decoder in accordance with claim 18, in which the synthesizer is operative to use coefficients for the linear combination of the head-related transfer functions, which depend on the level parameter.

20. Decoder in accordance with claim 18, in which the synthesizer is operative to use coefficients for the linear combination depending on additional multi-channel parameters related to additional spatial properties of the multi-channel signal.

21. Binaural decoder, comprising:

a decoder for deriving a headphone down mix signal using a representation of a down mix of a multi-channel signal and using a level parameter having information on a level relation between two channels of the multi-channel signal and using head-related transfer functions related to the two channels of the multi-channel signal, comprising:

a filter calculator for deriving a modified head-related transfer function by weighting and applying phase factors to the head-related transfer functions of the two channels using the level parameter such that the modified head-related transfer function is stronger influenced by the head-related transfer function of a channel having a higher level than by the head-related transfer function of a channel having a lower level and that a phase compensation of the head-related transfer functions of the two channels is achieved prior to a combination of weighted and phase-compensated head-related transfer functions of the two channels; and a synthesizer for deriving the headphone down mix signal using the modified head-related transfer function and the representation of the down mix signal;

an analysis filterbank for deriving the representation of the down mix of the multi-channel signal by subband filtering the downmix of the multi-channel signal; and a synthesis filterbank for deriving a time-domain headphone signal by synthesizing the headphone down mix signal.

22. Decoder for deriving a spatial stereo down mix signal using a representation of a down mix of a multi-channel signal and using a level parameter having information on a level relation between two channels of the multi-channel signal and using crosstalk cancellation filters related to the two channels of the multi-channel signal, comprising:

a filter calculator for deriving a modified crosstalk cancellation filters by weighting the crosstalk cancellation filters of the two channels using the level parameter such that the modified crosstalk cancellation filter is stronger influenced by the crosstalk cancellation filter of a channel having a higher level than by the crosstalk cancellation filter of a channel having a lower level and that a phase compensation of the crosstalk cancellation filters of the two channels is achieved prior to a combination of weighted and phase-compensated crosstalk cancellation filters of the two channels; and a synthesizer for deriving the spatial stereo down mix signal using the modified crosstalk cancellation filters and the representation of the down mix signal.

23. Method of deriving a headphone down mix signal using a representation of a down mix of a multi-channel signal and using a level parameter having information on a level relation between two channels of the multi-channel signal and using head-related transfer functions related to the two channels of the multi-channel signal, the method comprising:

deriving, using the level parameter, a modified head-related transfer functions by weighting and applying phase factors to the head-related transfer functions of the two channels such that the modified head-related transfer function is stronger influenced by the head-related transfer function of a channel having a higher level than by the head-related transfer function of a channel having a lower level and that a phase compensation of the head-related transfer functions of the two channels is achieved prior to a combination of weighted and phase-compensated head-related transfer functions of the two channels; and deriving the headphone down mix signal using the modified head-related transfer functions and the representation of the down mix signal.

24. Receiver or audio player having a decoder for deriving a headphone down mix signal using a representation of a down mix of a multi-channel signal and using a level parameter having information on a level relation between two channels of the multi-channel signal and using head-related transfer functions related to the two channels of the multi-channel signal, the decoder comprising:

a filter calculator for deriving modified head-related transfer functions by weighting and applying phase factors to the head-related transfer functions of the two channels using the level parameter such that a modified head-related transfer function is stronger influenced by the head-related transfer function of a channel having a higher level than by the head-related transfer function of a channel having a lower level and that a phase compensation of the head-related transfer functions of the two channels is achieved prior to a combination of weighted and phase-compensated head-related transfer functions of the two channels; and a synthesizer for deriving the headphone down mix signal using the modified head-related transfer function and the representation of the down mix signal.

25. Method of receiving or audio playing, the method having a method for deriving a headphone down mix signal using a representation of a down mix of a multi-channel signal and using a level parameter having information on a level relation between two channels of the multi-channel signal and using head-related transfer functions related to the two channels of the multi-channel signal, the method comprising:

deriving, using the level parameter, modified head-related transfer functions by weighting and applying phase factors to the head-related trans-fer functions of the two channels such that a modified head-related trans-fer function is stronger influenced by the head-related trans-fer function of a channel having a higher level than by the head-related transfer function of a channel having a lower level and that a phase compensation of the head-related transfer functions of the two channels is achieved prior to a combination of weighted and phase-compensated head-related transfer functions of the two channels; and deriving the headphone down mix signal using the modified head-related transfer functions and the representation of the down mix signal.

26. A non-transitory computer-readable storage medium storing a program executable by a processor implementing the steps of:

deriving a headphone down mix signal using a representation of a downmix of a multi-channel signal and using a level parameter having information on a level relation between two channels of the multi-channel signal and using head-related transfer functions related to the two channels of the multi-channel signal, comprising:

deriving, using the level parameter, modified head-related transfer functions by weighting and applying phase factors to the head-related transfer functions of the two channels such that a modified head-related transfer function is stronger influenced by the head-related transfer function of a channel having a higher level than by the head-related transfer function of a channel having a lower level and that a phase compensation of the head-related transfer functions of the two channels is achieved prior to a combination of weighted and phase compensated head-related transfer functions of the two channels; and deriving the headphone down mix signal using the modified head-related transfer functions and the representation of the down mix signal.

27. A non-transitory computer-readable storage medium storing a program executable by a processor implementing the steps of:

receiving or audio playing, deriving a headphone down mix signal using a representation of a down mix of a multi-channel signal and using a level parameter having information on a level relation between two channels of the multi-channel signal and using head-related transfer functions related to the two channels of the multi-channel signal, comprising:

deriving, using the level parameter, modified head-related transfer functions by weighting and applying phase factors to the head-related transfer functions of the two channels such that a modified head-related transfer function is stronger influenced by the head-related transfer function of a channel having a higher level than by the head-related transfer function of a channel having a lower level and that a phase compensation of the head-related transfer functions of the two channels is achieved prior to a combination of weighted and phase compensated head-related transfer functions of the two channels; and deriving the headphone down mix signal using the modified head-related transfer functions and the representation of the down mix signal.

* * * * *